US008529223B2

(12) United States Patent
Cohoon et al.

(10) Patent No.: US 8,529,223 B2
(45) Date of Patent: Sep. 10, 2013

(54) DUAL DIAPHRAGM PUMP ASSEMBLY FOR A SANITATION SYSTEM

(75) Inventors: William R. Cohoon, Canton, MI (US); George Grech, Garden City, MI (US); Steven A. Meyer, Whitmore Lake, MI (US)

(73) Assignee: Thetford Corporation, Ann Arbor, MI (US)

( * ) Notice: Subject to any disclaimer, the term of this patent is extended or adjusted under 35 U.S.C. 154(b) by 786 days.

(21) Appl. No.: 12/245,051

(22) Filed: Oct. 3, 2008

(65) Prior Publication Data

US 2009/0092505 A1 Apr. 9, 2009

Related U.S. Application Data

(60) Provisional application No. 60/978,578, filed on Oct. 9, 2007.

(51) Int. Cl.
*F04B 17/00* (2006.01)

(52) U.S. Cl.
USPC ..... 417/413.1; 417/393; 417/534; 4/433; 4/332

(58) Field of Classification Search
USPC ..... 417/413.1, 393, 521, 534, 553.7; 4/332, 431–433
See application file for complete search history.

(56) References Cited

U.S. PATENT DOCUMENTS

| | | | | |
|---|---|---|---|---|
| 3,039,399 | A * | 6/1962 | Everett | 417/536 |
| 3,228,036 | A * | 1/1966 | Gast et al. | 4/320 |
| 3,741,689 | A * | 6/1973 | Rupp | 417/393 |
| 4,931,000 | A | 6/1990 | Felming, Jr. | 417/534 |
| 5,551,843 | A | 9/1996 | Hauser | 417/234 |
| 5,649,809 | A | 7/1997 | Stapelfeldt | 417/63 |
| 5,836,751 | A | 11/1998 | De Villiers | 417/413.1 |
| 5,851,109 | A | 12/1998 | Reynolds | |
| 6,082,979 | A | 7/2000 | Friedman | 417/566 |
| 6,126,419 | A | 10/2000 | Hansen | 417/536 |
| 6,354,817 | B1 | 3/2002 | Chang | 417/413.1 |
| 7,013,793 | B2 | 3/2006 | Dang | 92/99 |
| 2003/0012668 | A1 | 1/2003 | Simmons | |
| 2005/0191190 | A1 | 9/2005 | Maki et al. | 417/410.1 |
| 2005/0271525 | A1 | 12/2005 | Muramatsu et al. | 417/413.1 |

FOREIGN PATENT DOCUMENTS

| | | |
|---|---|---|
| EP | 1 972 728 A | 9/2008 |
| GB | 539 247 A | 9/1941 |
| JP | 03 119230 A | 5/1991 |

OTHER PUBLICATIONS

European Search Report for Application No. EP 08 01 7599; dated Jan. 22, 2009, 7 Pages.

* cited by examiner

*Primary Examiner* — Devon Kramer
*Assistant Examiner* — Thomas Fink
(74) *Attorney, Agent, or Firm* — Harness, Dickey & Pierce, P.L.C.

(57) ABSTRACT

A pump assembly includes a housing defining a working chamber, a water pump chamber and a waste pump chamber. A first diaphragm separates the water pump chamber and the working chamber. A second diaphragm separates the waste pump chamber and the working chamber. A common driver member interconnects the first diaphragm and the second diaphragm. Movement of the driven member to a first position creates a positive pressure in the water pump chamber and a negative pressure in the waste pump chamber. Movement of the driven member to a second position creates a negative pressure in the water pump chamber and a positive pressure in the waste pump chamber.

7 Claims, 11 Drawing Sheets

DUAL DIAPHRAGM PUMP ASSEMBLY FOR A SANITATION SYSTEM

CROSS-REFERENCE TO RELATED APPLICATIONS

This application claims the benefit of U.S. Provisional Application No. 60/978,578, filed on Oct. 9, 2007. The entire disclosure of the above application is incorporated herein by reference.

FIELD

The present teachings generally relate to dual diaphragm assemblies. More particularly, the present teachings relate to a dual diaphragm assembly for a sanitation system. Additionally, the present teachings relate to a diaphragm assembly for a sanitation system having a waste chamber that drains toward an outlet.

BACKGROUND

A flush toilet basically operates to deliver a source of flush water to a bowl and transfer waste from the bowl to a remote location. Various types of systems are known, ranging from toilets that rely exclusively on flushing water for the transfer of waste to the remote location to vacuum system for assisting in the transfer of waste. While known systems have proven to be generally acceptable for their intended uses, a continuous need remains for improvement in the pertinent art.

SUMMARY

According to one particular aspect, the present teachings may provide a sanitary system includes a toilet, a source of flush water in fluid communication with the toilet, and a dual diaphragm pump assembly. The pump assembly includes a housing defining a working chamber, a water pump chamber and a waste pump chamber. A first diaphragm is disposed in the housing. The first diaphragm separates the water pump chamber and the working chamber. A second diaphragm is disposed in the housing. The second diaphragm separates the waste pump chamber and the working chamber. A common driver member interconnects the first diaphragm and the second diaphragm. A water inlet at least partially defines a water inlet path between a source of flush water and the water pump chamber. A water outlet at least partially defines a water outlet path between the water pump chamber and a bowl of the toilet. A waste inlet at least partially defines a waste inlet path between the bowl of the toilet and the waste pump chamber. A waste outlet is in fluid communication with the waste chamber. Movement of the driven member to a first position creates a positive pressure in the water pump chamber and a negative pressure in the waste pump chamber. Movement of the driven member to a second position creates a negative pressure in the water pump chamber and a positive pressure in the waste pump chamber.

According to another aspect, the present teachings may provide a waste pump for a sanitary system. The waste pump includes a housing defining a working chamber and a waste chamber. The waste chamber has a horizontally extending portion and a vertically extending portion. A waste diaphragm is disposed in the housing. The waste diaphragm separates the waste chamber and the working chamber. A driver member is disposed in the housing and is interconnected to the waste diaphragm. A waste inlet is in fluid communication with the vertically extending portion of the waste chamber. A waste outlet is in fluid communication with the vertically extending portion of the waste chamber. Movement of the driven member to a first position creates a negative pressure in the waste pump chamber and movement of the driven member to a second position creates a positive pressure in the waste pump chamber.

Further areas of applicability of the present teachings will become apparent from the detailed description provided hereinafter. It should be understood that the detailed description and specific examples, while indicating exemplary embodiments of the invention, are intended for purposes of illustration only and are not intended to limit the scope of the invention.

DRAWINGS

The present teachings will become more fully understood from the detailed description and the accompanying drawings in which the disclosed subject matter is drawn to scale, wherein.

DETAILED DESCRIPTION

The following description of various aspects of the present teachings is merely exemplary in nature and is in no way intended to limit the invention, its application or uses.

Figure 1:
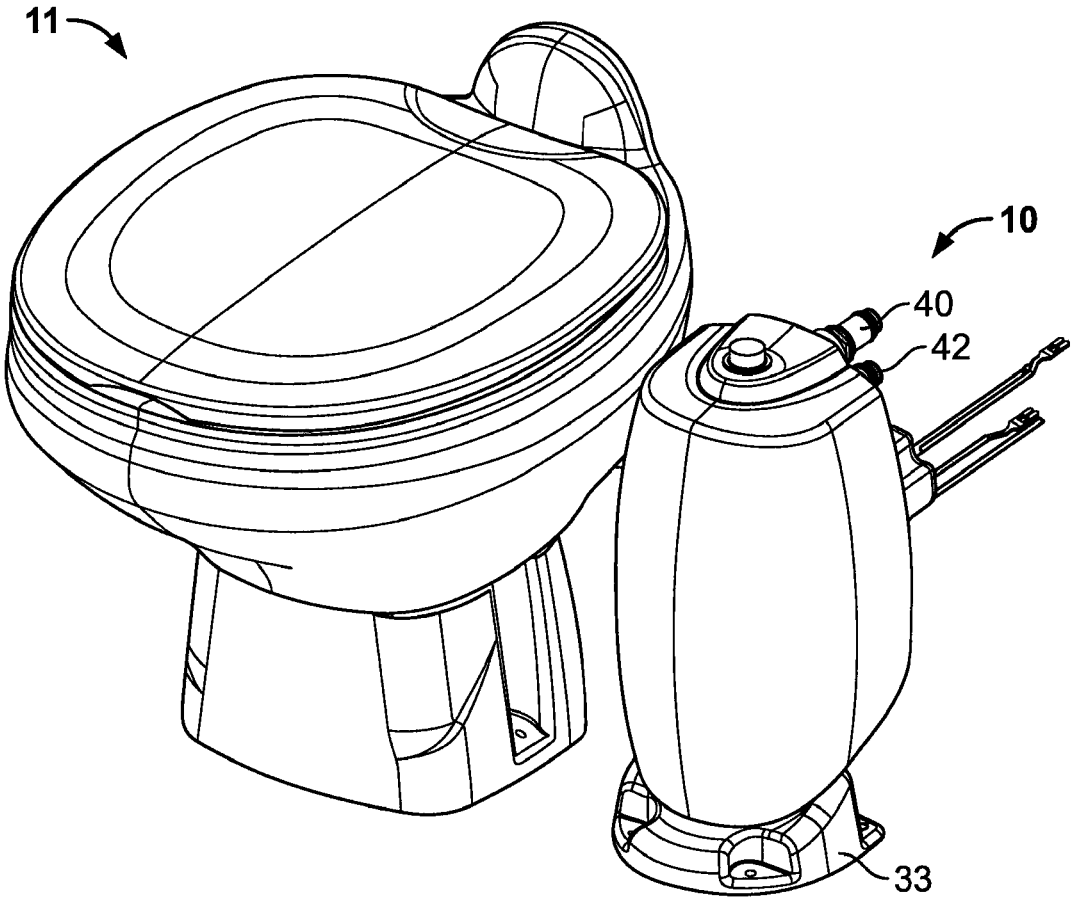
FIG. 1 is an environmental view of a sanitation system in accordance with the present teachings.
Figure 2A:
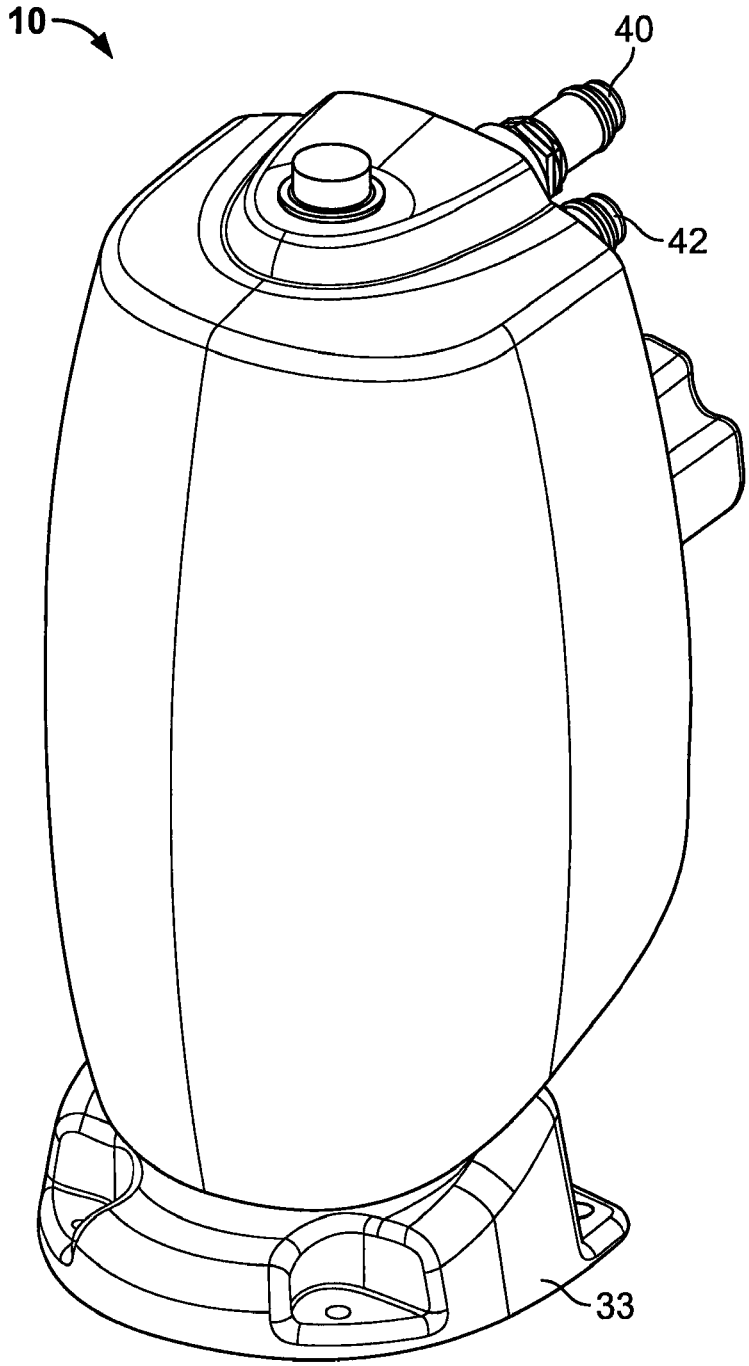
FIG. 2 is a perspective view of a pump assembly and associated shroud in accordance with the present teachings.
Figure 2B:
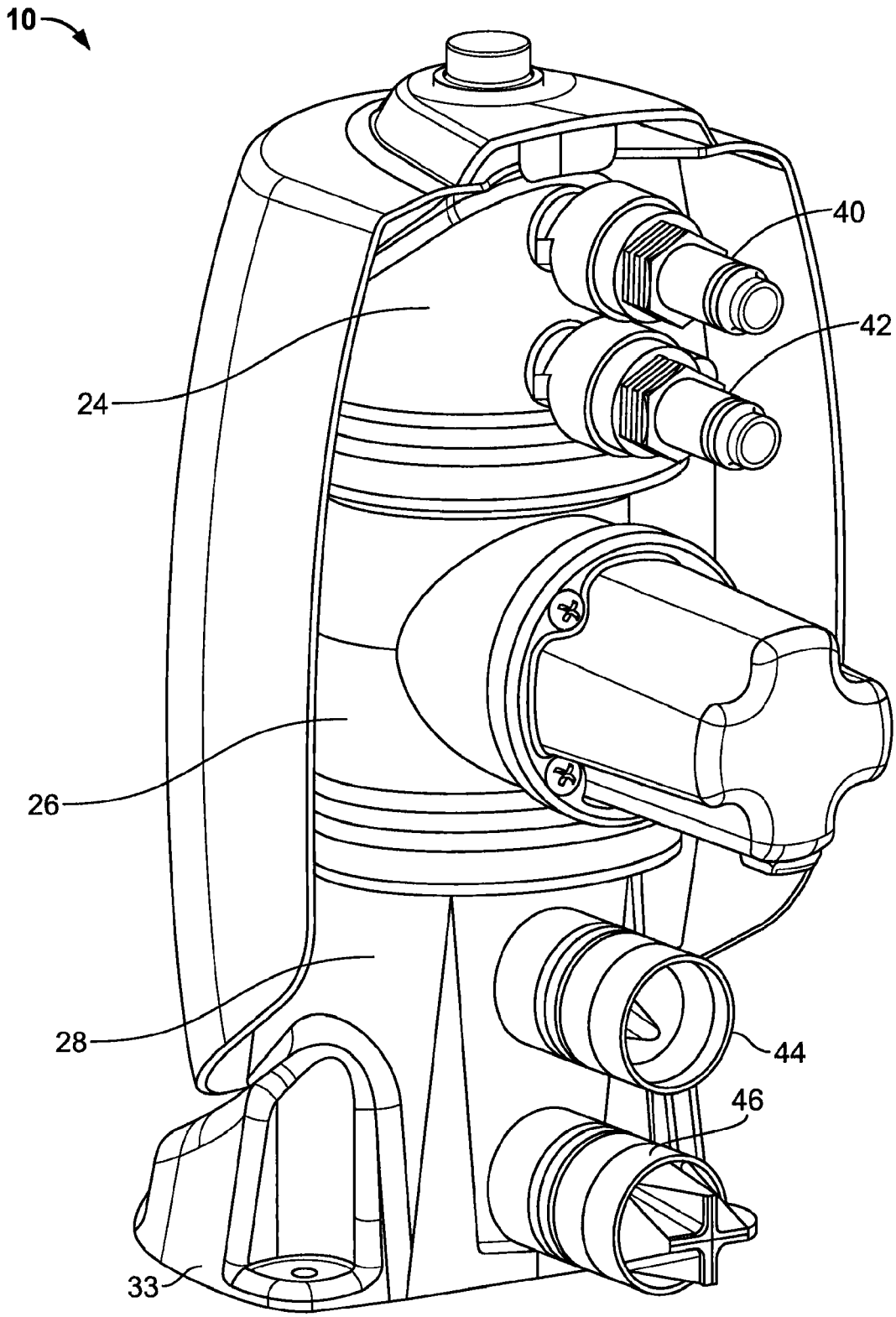
Figure 3:
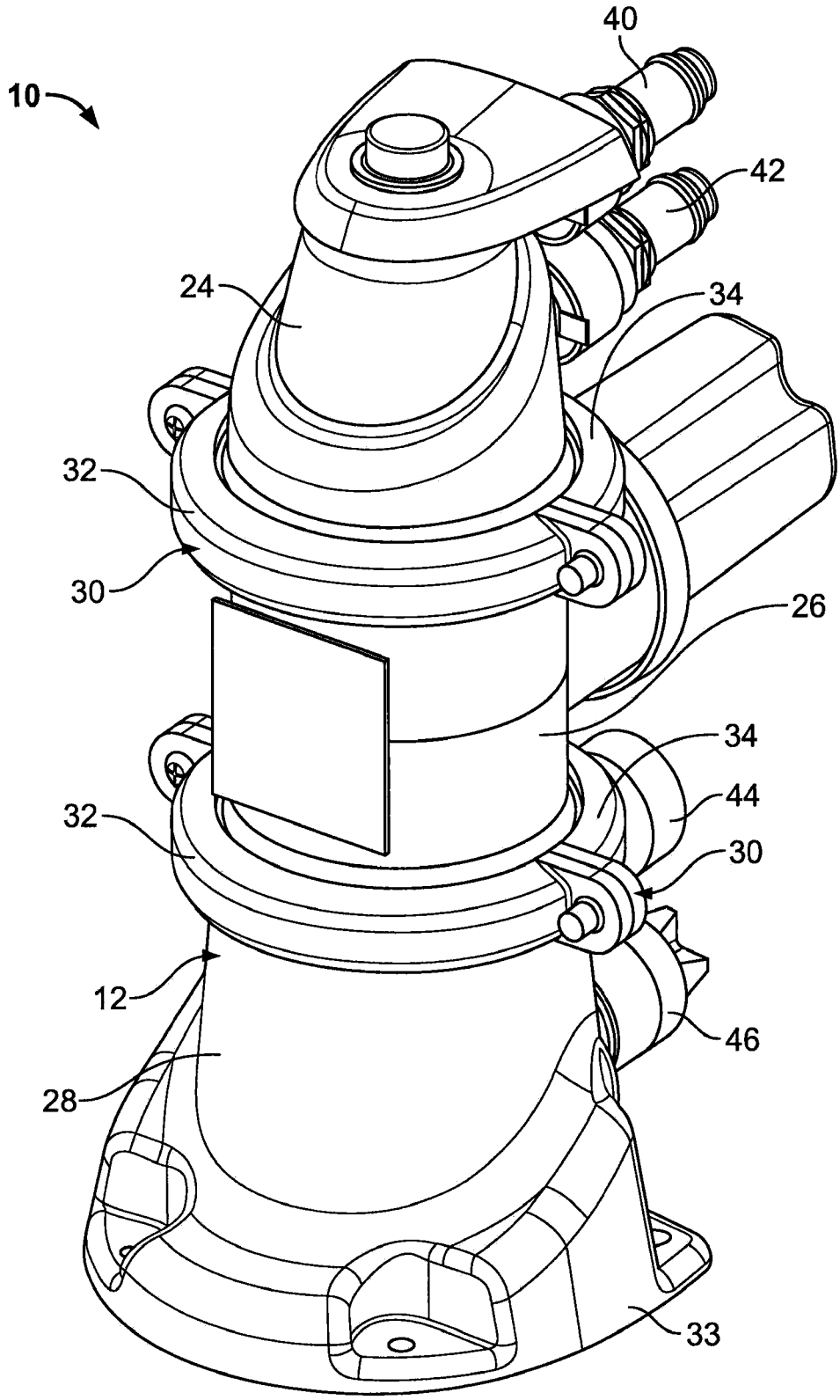
FIG. 3 is another perspective view of a pump assembly and associated shroud in accordance with the present teachings.
Figure 4:
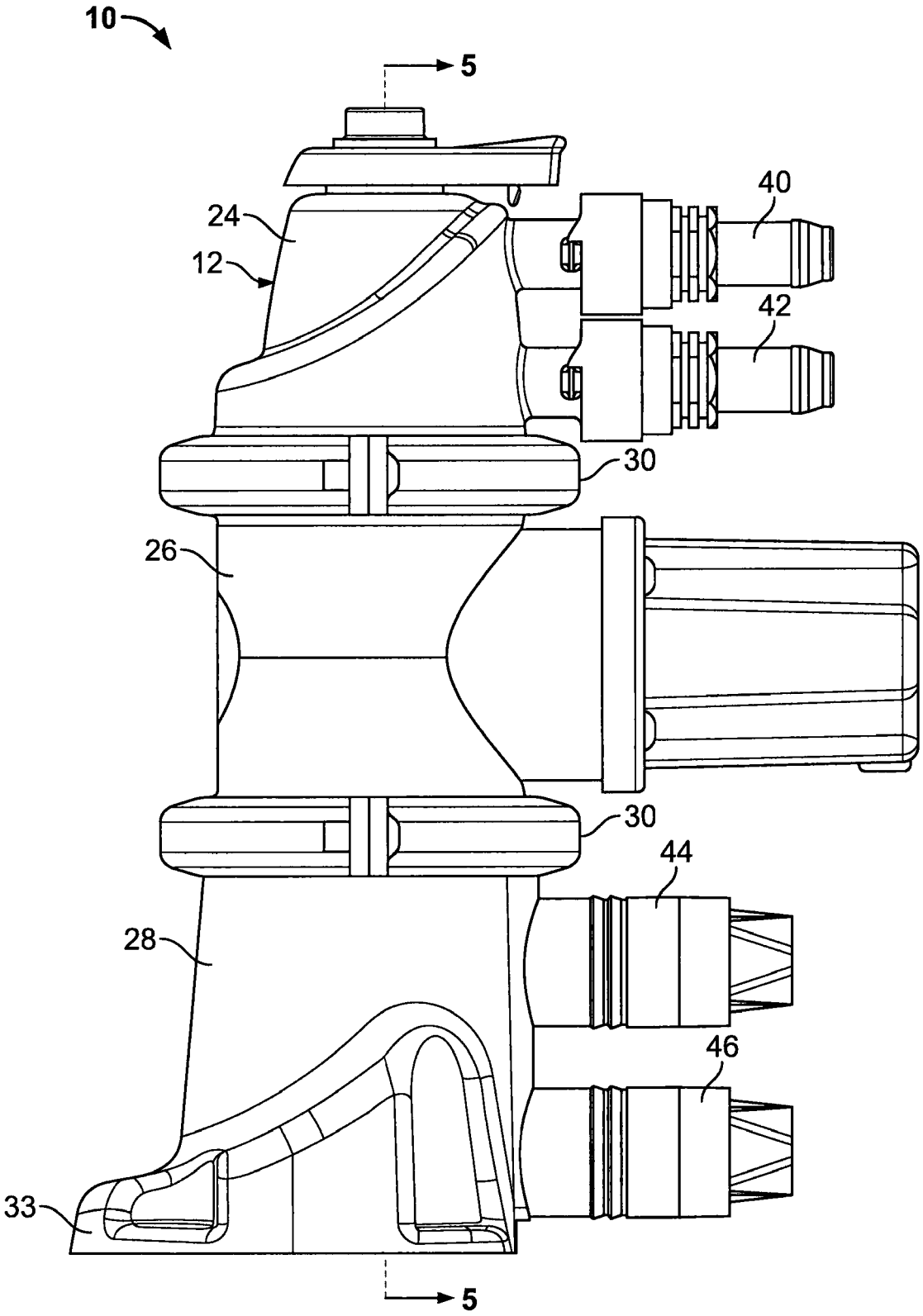
FIG. 4 is a side view of a pump assembly in accordance with the present teachings.

With initial reference to the environmental view of FIG. 1, a sanitation system including a pump assembly 10 constructed according to the teachings of the present disclosure is illustrated. The sanitation system is generally illustrated to include a flush toilet 11 and generally identified at reference character 10. The particular toilet 11 shown in the drawings will be understood to be merely exemplary. In this regard, it will be appreciated the teachings of the present disclosure are not limited to any particular toilet.

With continued reference to FIG. 1 and additional reference to FIGS. 2 through 9, the pump assembly 10 will be further described. In one particular application the pump assembly may be a dual diaphragm pump assembly 10 that is operative for delivering a source of flush water 13 to the toilet 11 and further operative for pumping waste water from the toilet 11. The pump assembly 10 may include a housing 12. As perhaps best shown in the cross-sectional views of FIGS. 5 and 7, the housing 12 may define a plurality of chambers. The plurality of chambers may include a first chamber 14, a second chamber 16 and a third chamber 18. The first chamber may be a working chamber 14. The second chamber may be a water chamber 16. The third chamber may be a waste chamber 18.

The working chamber 14 is disposed between the water chamber 16 and the waste chamber 18. In the embodiment illustrated, the chambers 14-18 are horizontally arranged with the water chamber 16 above the working chamber 14 and the waste chamber 18 below the working chamber 14. In other embodiments, water chamber 16 may be disposed below the working chamber 14 and the waste chamber 18 above the working chamber 14. In still other embodiments, the chambers 14-18 may be vertically arranged.

A first membrane or diaphragm 20 may be disposed within the housing 12 to separate the working chamber 14 from the first chamber 16. A second membrane or diaphragm 22 may be disposed within the housing 12 to separate the working chamber 14 from the second chamber 16. The diaphragms 20 and 22 may be constructed of EPDM, other rubber or other suitable material. As will be addressed below, the diaphragms 20, 22 may be constructed to cooperate with the housing 12 to retain the diaphragms 20, 22 relative to the housing 12.

The housing 12 may include a plurality of sections. The sections may be generally cylindrical or of other suitable shape. As illustrated, the housing 12 may include a first or upper section 24, a second or intermediate section 26 and a third or lower section 28. The first diaphragm 20 may be peripherally captured between the first and second sections 24 and 26 of the housing 12. The second diaphragm 22 may be peripherally captured between the second and third sections 26 and 28 of the housing 12. The sections of the housing 24, 26 and 28 may be constructed of polypropylene or other suitable material.

Figure 5:
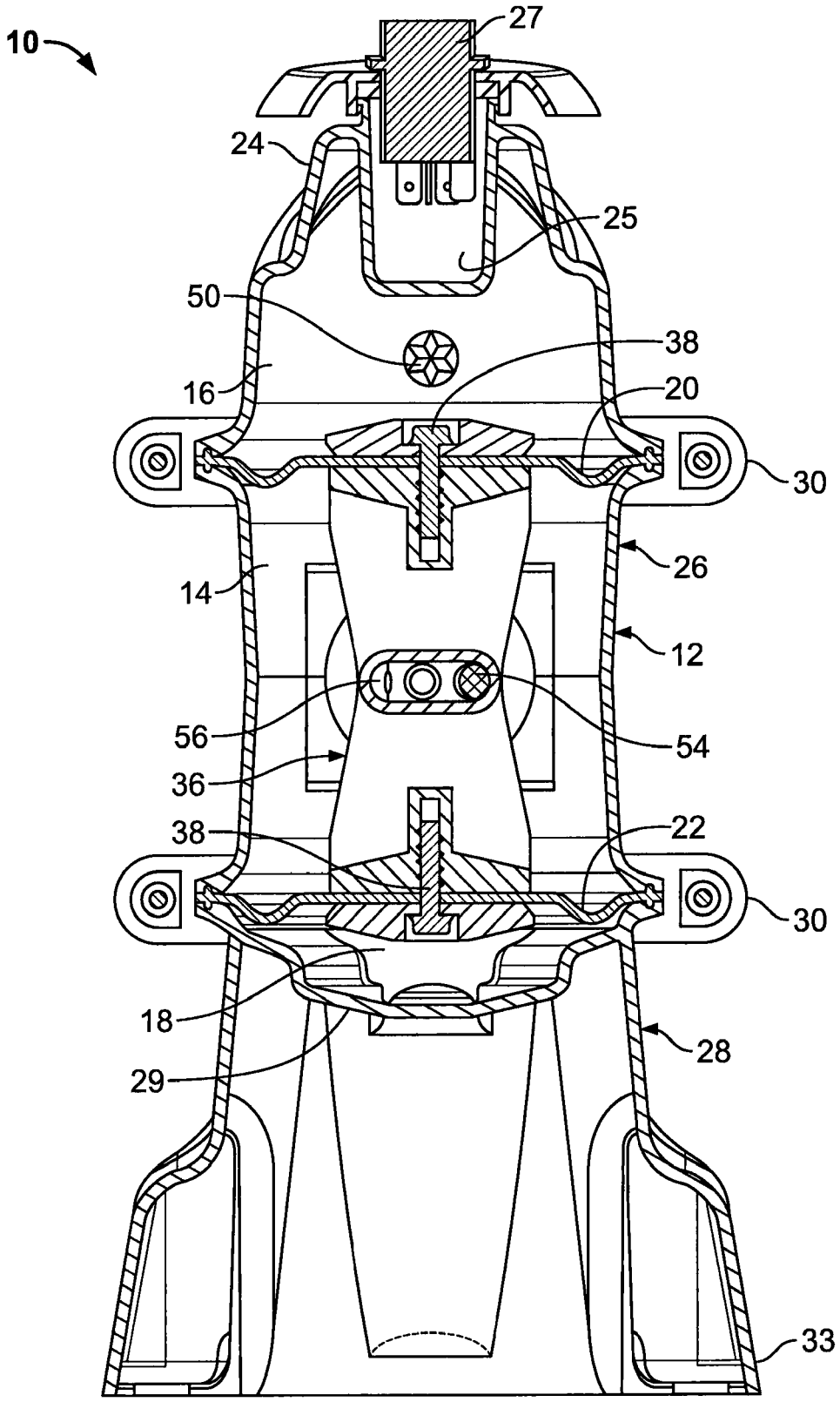
FIG. 5 is a cross-sectional view taken along the line 5-5 of FIG. 4.
Figure 6:
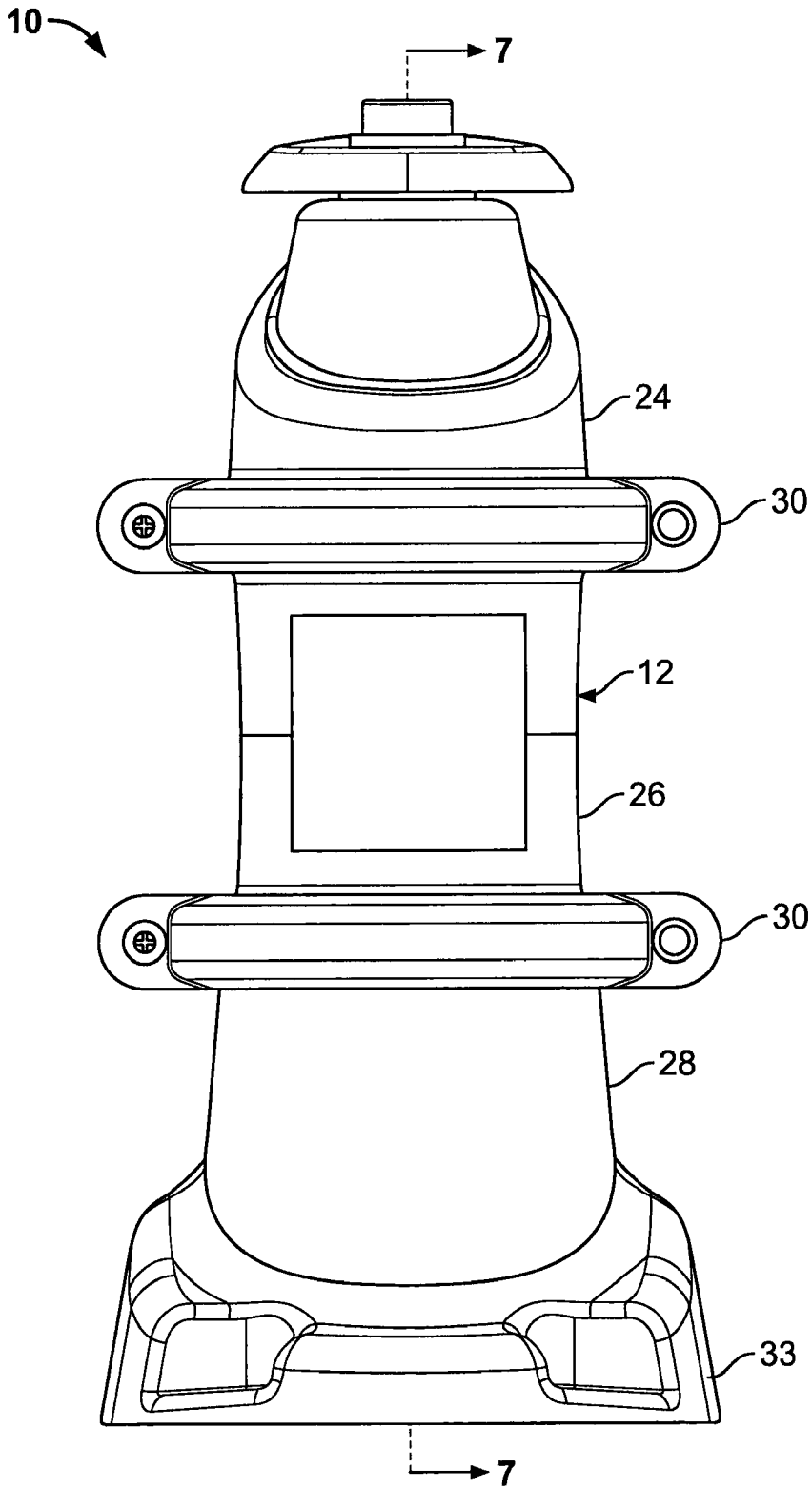
FIG. 6 is a front view of a pump assembly in accordance with the present teachings.
Figure 7:
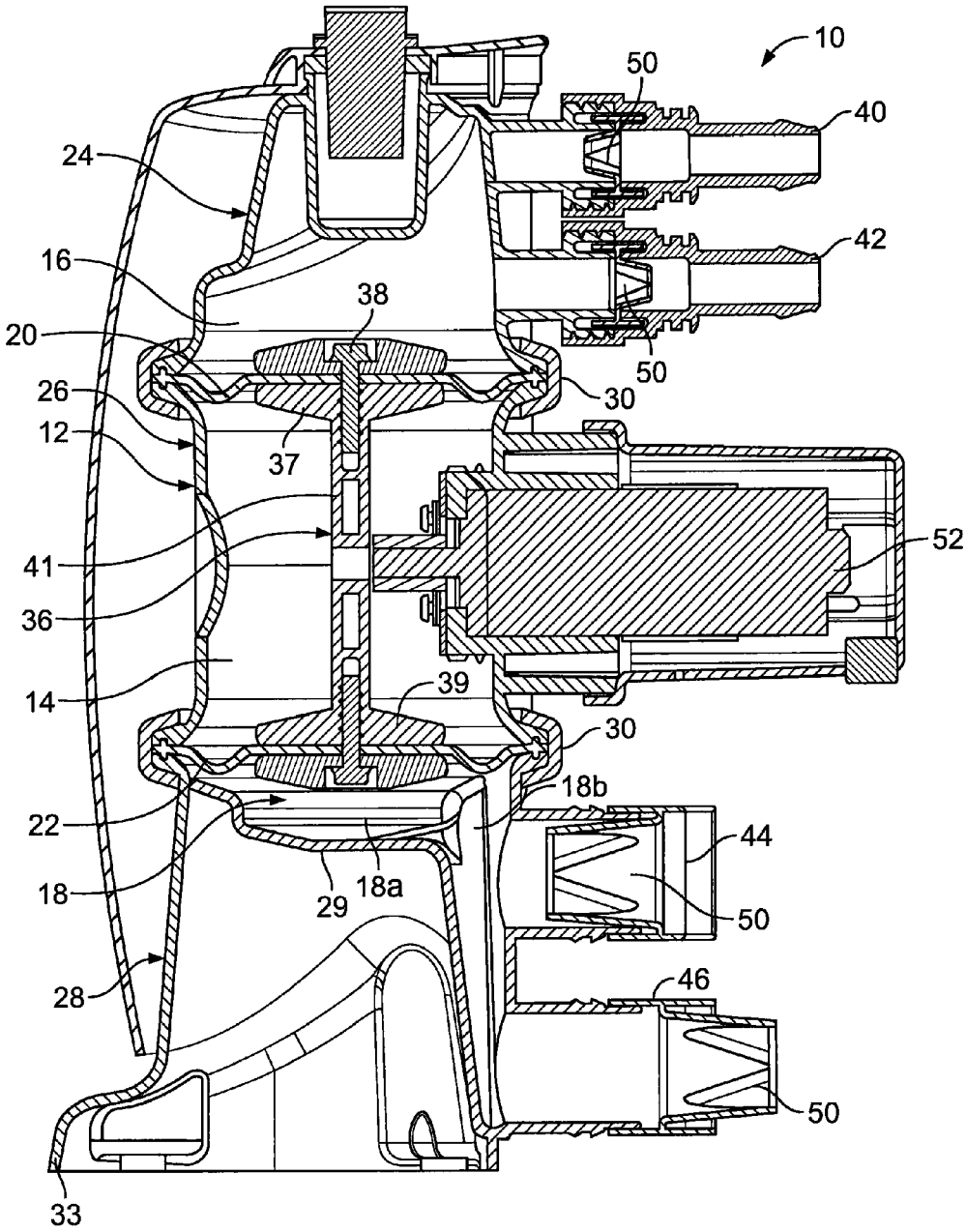
FIG. 7 is a cross-sectional view taken along the line 7-7 of FIG. 6.
Figure 7A:
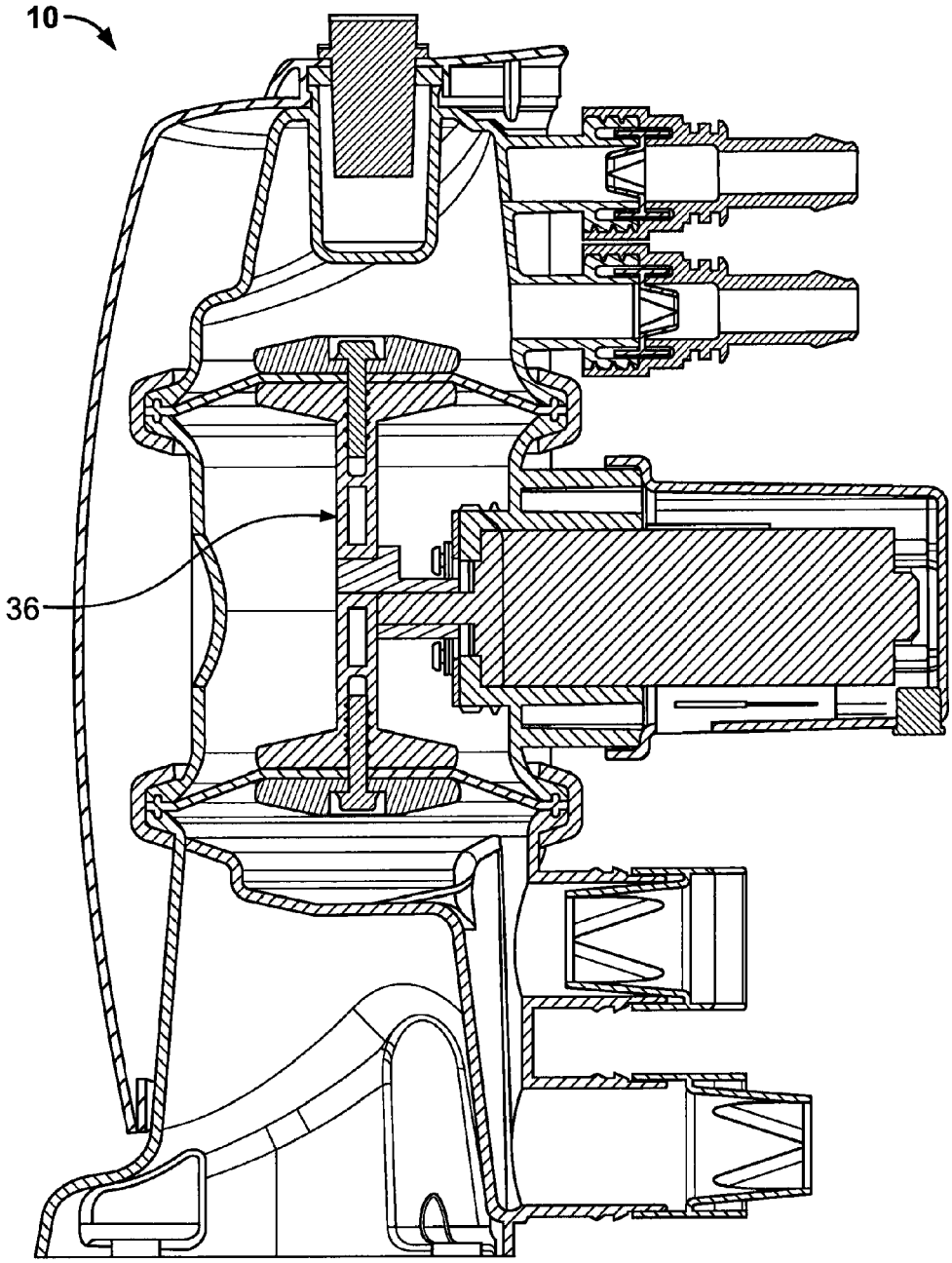
FIG. 7A is a cross-sectional view similar to FIG. 7, illustrating the driven member in a first position.
Figure 7B:
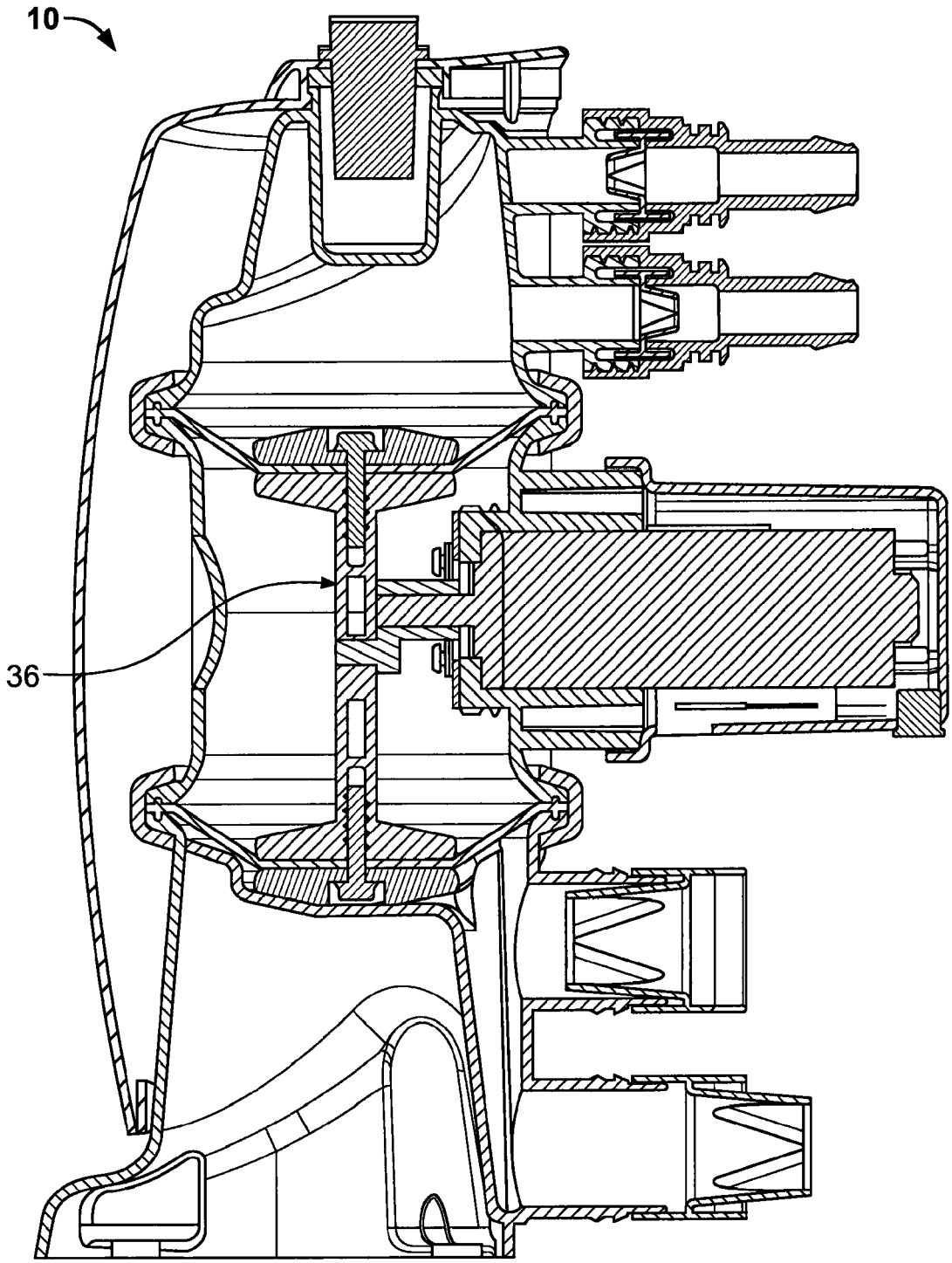
FIG. 7B is a cross-sectional view similar to FIG. 7, illustrating the driven member in a second position.
Figure 8:
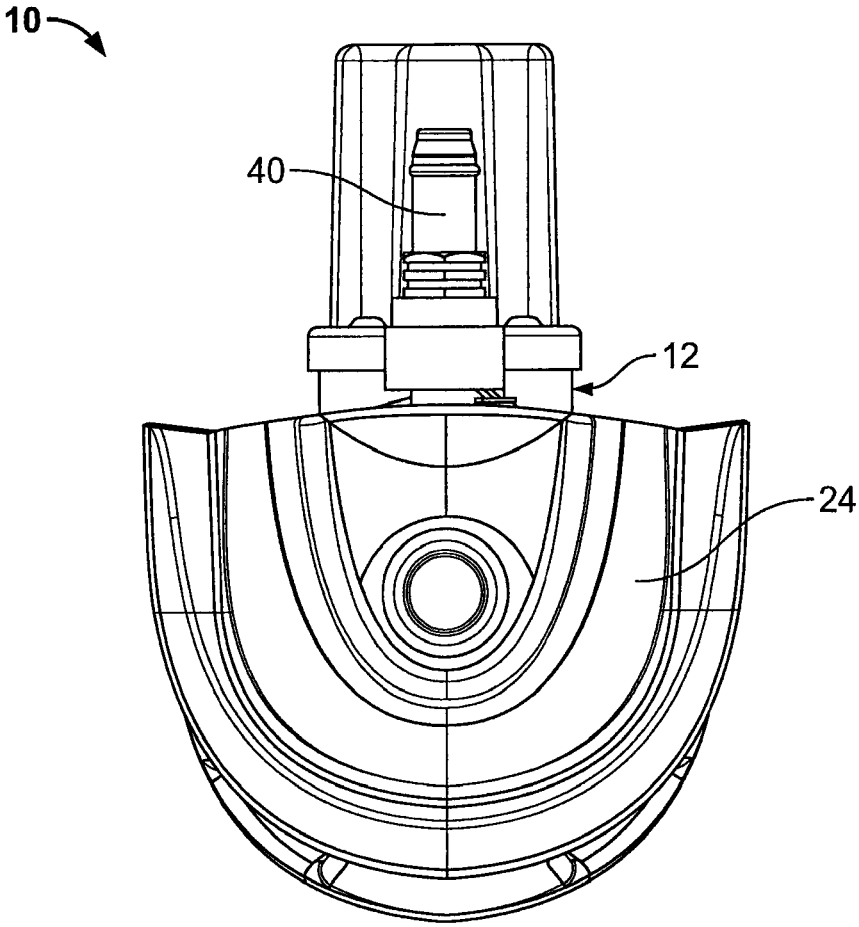
FIG. 8 is a top view of a pump assembly in accordance with the present teachings.
Figure 9:
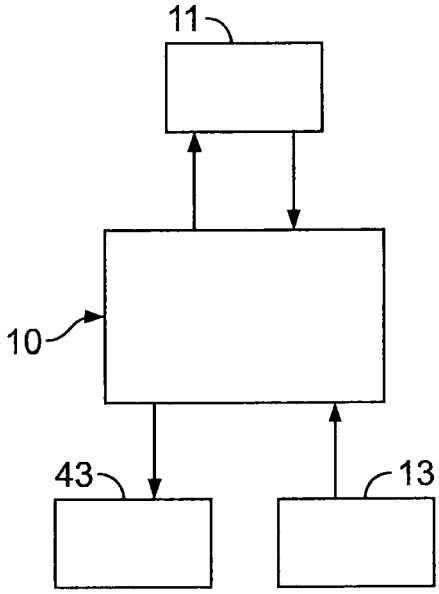
FIG. 9 is a schematic view of a sanitation in accordance with the present teachings.

As shown, the adjacent sections of the housing 12 may be integrally formed to include cooperating peripheral flanges for capturing the respective diaphragms 20, 22. The diaphragms 20, 22 may be formed to include upper and lower peripheral beads. As shown in FIG. 5, for example, the radially outermost portion of the diaphragms 20, 22 may have a generally t-shaped cross section. The peripheral beads of the diaphragms 20, 22 may be received in corresponding peripheral grooves of the adjacent housing sections.

The upper section 24 of the housing 12 may define an upper cavity 25. The upper cavity 25 may receive a switch 25 for controlling actuation of the pump assembly 10. Operation of the switch 25 will be understood to be conventional insofar as the present teachings are concerned.

The third section 28 may be integrally or otherwise formed to include a base portion 33 suitable for mounting the pump assembly 10 to a floor or other rigid surface with fasteners or the like. As perhaps most particularly shown in FIG. 7, the third section 28 may be further formed to include a chamber floor 29. The chamber floor 29 may be oriented generally horizontally and upwardly spaced from the base portion 33.

The configuration of the waste chamber 18 allows the pump assembly 10 to more effectively move water and sewage given a lack of air within the chamber 18. This is because water is incompressible as opposed to air. With a lack of air in the waste chamber 18 and a negative pressure created by the diaphragm 22, water/sewage will substantially fill the waste chamber 18. Then, with a positive pressure created by the diaphragm 20, the waste chamber 18 near completely empties the water/sewage to more effectively draw in the most amount of water/sewage possible in the next movement of the diaphragm 22. The waste chamber 18 is also particularly designed to drain completely toward the outlet 46 when the pump is off assembly 10, such drainage reducing the amount of sewage left in the pump assembly 10, thereby reducing the odor permeating from the toilet 11.

The first and second sections 24 and 26 may be coupled to one another with a clamp arrangement 30 that circumferentially surrounds the housing 12. Similarly, the second and third sections 26 and 28 may be coupled to one another with a substantially identical clamp arrangement 30 that circumferentially surrounds the housing 12. The clamp arrangements 30 may include first and second components 32 and 34 coupled to one other with fasteners or in any manner well known in the art. The clamp arrangements 30 may define a circumferential groove for receiving the cooperating flanges of the adjacent housing sections. The clamp arrangements 30 may be constructed of acetal, polyoxymethylene, other plastic, or other suitable material.

A driven member or shaft 36 may be disposed in the housing 12 for reciprocal movement and may interconnect the first and second diaphragms 20 and 22 between a first position and a second position. The driven member 36 may include disc-shaped upper and lower members 37 and 39 coupled by an intermediate member 41. The driven member 36 may be coupled to the respective diaphragms 20 and 22 with fasteners 38, for example. Washers may be positioned on the side of the diaphragms 20 and 22 opposite the respective disc-shaped members 37 and 39. The fasteners 38 may pass through the washers and the respective diaphragm 20 or 22 and threadably engage the respective upper or lower member 37 or 39.

The driven member 36 is illustrated throughout the drawings in a neutral position between the first position and the second position. With reference to the cross-sectional views of FIGS. 5 and 7, for example, the first position is upwardly displaced from that illustrated within the limits defined by the diaphragms 20 and 22. Conversely and again with reference to FIGS. 5 and 7, the second position is downwardly displaced from that illustrated within the limits defined by the diaphragms 20 and 22.

A water inlet 40 may at least partially define a water inlet path between the source of flush water 13 and the water chamber 16. A water outlet 42 may at least partially define a water outlet path between the water chamber 16 and a bowl of the toilet (not shown). A waste inlet 44 may at least partially define a waste inlet path between the bowl of the toilet and the waste chamber 18. A waste outlet 46 may be in fluid communication with the waste chamber 18. The waste outlet 46 may be disposed proximate the bottom of the waste chamber 18 to facilitate drainage of the waste chamber 18. Valves 50 may be disposed in each of the water inlet path, the water outlet path, the waste inlet path and the waste outlet path for controlling the flow of water and waste. The valves may be one-way valves 50.

A rotatable motor arm 52 may be coupled to the shaft 36 for reciprocating the shaft 36 between the first and second position. When the motor arm 52 is rotated about its axis, a crank arm 54 may turn inside a slot 56 (see FIG. 5, for example) in the shaft 36. Due to an offset of the crank arm 54, the shaft 36 is reciprocally driven in opposition vertical directions, thereby displacing both diaphragms 20 and 22 in vertical directions. The motor associated with the motor arm 52 may be an electrical motor. The switch 37 carried at the top of the pump assembly 10 may actuate the electrical motor.

In response to actuation by the switch 37, the driven member 36 is reciprocated between the first and second positions. The diaphragms 20 and 22 simultaneously cooperate with the associated one-way valves 50 operate to create a negative pressure to draw fluid into each pump and then a positive pressure to push fluid out of each pump. More particularly, when the driven member 36 moves the first position (up in FIG. 5, water is drawn from the flush water source 13 and pumped to the toilet 11. When the driven member 36 moves to the second position (down in FIG. 5) waste is drawn from the toilet 11 and pumped to a remote area 43. The remote area 43 may be a holding tank, a sewer or other receptacle.

The waste chamber 18 is particularly adapted to pump water/sewage out of the toilet 11 and into a holding tank assembly 10, sewer, or overboard in addition to being mounted to the floor and support the pump in a vertical orientation. The work chamber 14 includes a horizontally extending portion 18A in communication with a vertically extending portion 18B. The horizontally extending portion 18A is sized and positioned such that upon downward translation of the shaft 36, contents within the horizontally extending portion 18A are near completely displaced.

The sanitation system may further include shroud for substantially concealing the pump assembly 10. The shroud may be secured to the pump assembly 10 in any manner well known in the art. The shroud provides a neat appearance and a surface that is easy cleaned.

It will now be appreciated that a pump assembly 10 is provided potentially having a lower cost, quieter operation and a more reliable mechanism. In this regard, the dual diaphragm arrangement of the present teachings compares favorably with conventionally pumping mechanism incorporating a hard plastic impeller for evacuating waste from a bowl and a flexible rubber impeller that supplies fresh water to the bowl. Such conventional structures are loud and experience significant wear when run dry. The dual diaphragm arrangement of the present teachings greatly reduces noise associated with the pump assembly 10 and has the ability to run dry for extended periods of time without undue wear.

As shown in the drawings, the present teachings may be used to provide a common unit for both waste and water pumping. The flexibility of the present teachings anticipates additional applications. In this regard, the present teachings may be used as a single waste pump by eliminating the water pump or a single water pump by eliminating the waste pump. Additionally, the present teachings may be adapted for use with a dual waste pump where the water pump is replaced with a second waste pump or a dual water pump where the waste pump is replaced with a second water pump.

The description of the present teachings is merely exemplary in nature and, thus, variations that do not depart from the gist of the invention are intended to be within the scope of the invention. Such variations are not to be regarded as a departure from the spirit and scope of the invention. Furthermore, the present invention has been described with reference to two particular embodiments having many common and some distinct features. One skilled in the art will recognize that these features may be used singularly or in any combination based on the requirements and specifications of a given application or design.

What is claimed is:

1. A pump assembly comprising:

a housing defining a working chamber, a first pump chamber and a second pump chamber;

a first diaphragm disposed in the housing, the first diaphragm separating the first pump chamber and the working chamber;

a second diaphragm disposed in the housing, the second diaphragm separating the second pump chamber and the working chamber;

a driven member interconnecting the first diaphragm and the second diaphragm, the driven member disposed within the housing for reciprocal movement;

a first inlet check valve in fluid communication with the first pump chamber, the first inlet check valve having a first diameter;

a first outlet check valve in fluid communication with the first pump chamber, the first outlet check valve having a second diameter;

a second inlet check valve in fluid communication with the second pump chamber, the second inlet check valve having a third diameter, the third diameter greater than both the first diameter and the second diameter;

a second outlet check valve in fluid communication with the second pump chamber, the second outlet check valve having a fourth diameter, the fourth diameter greater than both the first diameter and the second diameter; and a drive member coupled to the driven member for reciprocating the driven member;

the driven member configured such that movement of the driven member in a direction toward a first position creates a positive pressure in the first pump chamber and a negative pressure in the second pump chamber and movement of the driven member in a direction toward a second position creates a negative pressure in the first pump chamber and a positive pressure in the second pump chamber;

wherein the second pump chamber includes a generally L-shaped cross section having a horizontally extending portion and a vertically extending portion, the horizontally extending portion bounded on a lower side thereof by a wall, an upper end of the vertically extending portion in fluid communication with the horizontally extending portion, a lowermost portion of the vertically extending portion in fluid communication with the second outlet check valve such that movement of the driven member to the second position substantially empties the horizontally extending portion into the vertically extending portion to allow drainage out of the second outlet check valve.

2. A dual diaphragm pump assembly for delivering a source of flush water to a toilet and pumping waste water from the toilet, the dual diaphragm pump assembly comprising:

a housing defining a working chamber, a water pump chamber and a waste pump chamber;

a first diaphragm disposed in the housing, the first diaphragm separating the water pump chamber and the working chamber;

a second diaphragm disposed in the housing, the second diaphragm separating the waste pump chamber and the working chamber;

a common driven member interconnecting the first diaphragm and the second diaphragm;

a water inlet check valve disposed in a water inlet path between a source of flush water and the water pump chamber, the water inlet check valve having a first diameter;

a water outlet check valve disposed in a water outlet path between the water pump chamber and a bowl of the toilet, the water outlet check valve having a second diameter;

a waste inlet check valve disposed in a waste inlet path between the bowl of the toilet and the waste pump chamber, the waste inlet check valve having a third diameter, the third diameter being greater than both the first and second diameters; and a waste outlet check valve in fluid communication with the waste chamber, the waste outlet check valve having a fourth diameter, the fourth diameter being greater than both the first and second diameters;

the driven member configured such that movement of the driven member in a direction toward a first position creates a positive pressure in the water pump chamber and a negative pressure in the waste pump chamber and movement of the driven member in a direction toward a second position creates a negative pressure in the water pump chamber and a positive pressure in the waste pump chamber;

wherein the waste pump chamber includes a generally L-shaped cross section having a horizontally extending portion and a vertically extending portion, the horizontally extending portion bounded on a lower side thereof by a wall, an upper end of the vertically extending portion in fluid communication with the horizontally extending portion, a lowermost portion of the vertically extending portion in fluid communication with the waste outlet check valve such that movement of the driven member to the second position substantially empties the horizontally extending portion into the vertically extending portion to allow drainage out of the waste outlet check valve;

wherein the waste outlet extends horizontally outward from the vertically extending portion.

3. The dual diaphragm pump assembly of claim 2, in combination with the toilet.

4. The dual diaphragm pump assembly of claim 2, wherein the common driven member is a shaft mounted for reciprocation in the housing.

5. The dual diaphragm pump assembly of claim 4, further comprising:

a motor arm coupled to the shaft for reciprocating the shaft.

6. The dual diaphragm pump assembly of claim 2, wherein the waste outlet check valve is below the waste inlet check valve.

7. The dual diaphragm pump assembly of claim 2, wherein the waste outlet check valve is disposed proximate to a bottom of the waste chamber.

* * * * *